US006038985A

United States Patent [19]

Chang

[11] Patent Number: 6,038,985

[45] Date of Patent: Mar. 21, 2000

[54] DINING TABLE HAVING EXPANDABLE TABLE TOP

[75] Inventor: Sen-Jung Chang, Taichung Hsien, Taiwan

[73] Assignee: Pei Chi Enterprise Co., Ltd., Taichung Hsien, Taiwan

[21] Appl. No.: 09/087,979

[22] Filed: Jun. 1, 1998

[51] Int. Cl.[7] ..... A47B 1/00

[52] U.S. Cl. ..... 108/84; 108/86; 108/87

[58] Field of Search ..... 108/83, 84, 86, 108/89, 87, 143; 312/331, 334.12, 334.15, 334.18, 334.25, 334.26, 334.33, 334.39

[56] References Cited

U.S. PATENT DOCUMENTS

| | | | |
|---|---|---|---|
| 1,358,353 | 11/1920 | Zimmer | 108/84 X |
| 2,751,269 | 6/1956 | Hafekost | 108/87 |
| 5,735,220 | 4/1998 | Wang | 108/87 |

FOREIGN PATENT DOCUMENTS

| | | | |
|---|---|---|---|
| 678442 | 7/1939 | Germany | 108/87 |
| 1085711 | 10/1967 | United Kingdom | 108/86 |

*Primary Examiner*—Janet M. Wilkens
*Attorney, Agent, or Firm*—Browdy and Neimark

[57] ABSTRACT

A dining table consists of a locating frame which is supported by a frame support and is provided with a sliding mechanism mounted thereon to permit opening and closing of a first table top. A second table top is held between two fastening supports of the locating frame on the frame support. The sliding mechanism comprises two slide rail members. Each slide rail member has two slide plates and a frame strip. Each slide plate has four slide wheels and a traction unit fastened on the slide plate. Each slide plate of the two slide plates are slidably engaged on each of the two frame strips of the sliding mechanism. The second table top can be activated to extract or retract in an opening between the first table top after it has been opened on the sliding mechanism.

10 Claims, 5 Drawing Sheets

DINING TABLE HAVING EXPANDABLE TABLE TOP

FIELD OF THE INVENTION

The present invention relates generally to a table, and more particularly to a dining table having an expandable table top.

BACKGROUND OF THE INVENTION

Certain conventional dining tables have an expandable table top which is expanded by means of racks. The rack-type expandable dining table is rather cumbersome and expensive.

SUMMARY OF THE INVENTION

The primary objective of the present invention is to provide an improved dining table having an expandable table top. The dining table of the present invention is cost-effective. In addition, the table top of the dining table of the present invention can be easily expanded and retracted.

In keeping with the principle of the present invention, the foregoing objective of the present invention is attained by a dining table consisting of a locating frame, which is supported by a frame support and provided with a sliding mechanism mounted thereon to permit opening and closing of a first table top. A second table top is held between two fastening supports of the locating frame on the frame support. The sliding mechanism comprises two slide rail members. Each slide rail member has two slide plates and a frame strip. Each slide plate has four slide wheels and a traction unit fastened on the slide plate. Each slide plate of two slide plates are slidably engaged on each of the two frame strips of the sliding mechanism. The second table top can be actuated to extract or retract in an opening between the first table top after it has been opened on the sliding mechanism.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
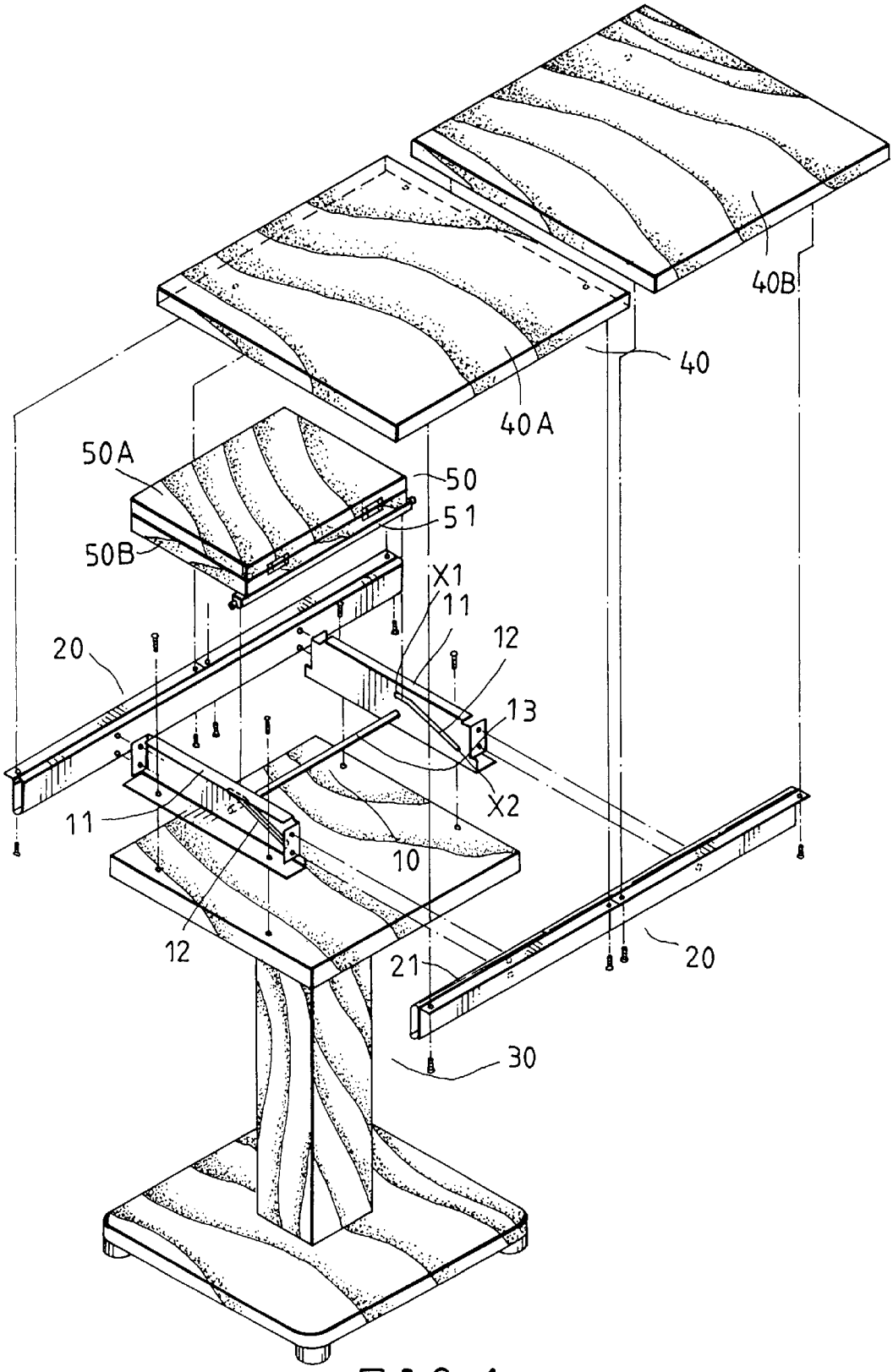
FIG. 1 shows an exploded view of the preferred embodiment of the present invention.
Figure 2:
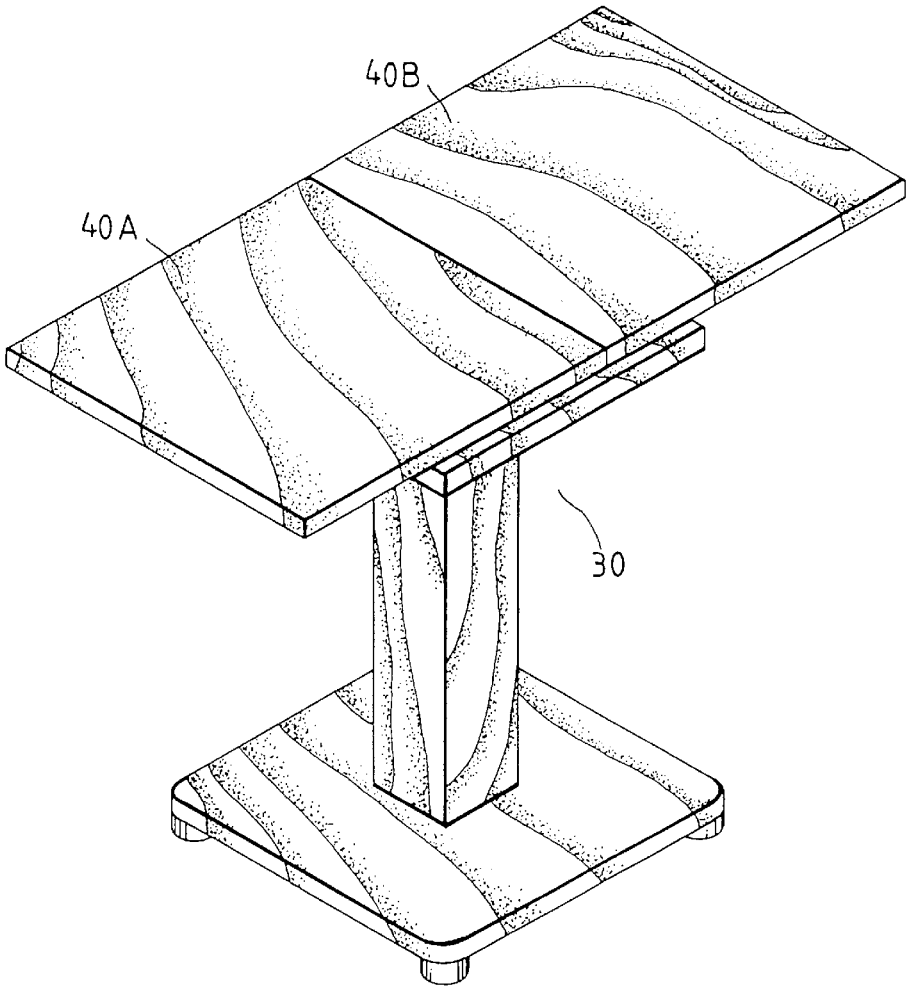
FIG. 2 shows a perspective view of the preferred embodiment of the present invention.

As shown in FIGS. 1–6, a dining table embodied in the present invention is composed of the component parts which are described explicitly hereinafter.

A locating frame 10 consists of two fastening supports 11 each having in the midsegment thereof a guide slot 12. The two fastening supports 11 are fastened with two ends of a locating rod 13 which is located under an upper initial point X1 of the guide slot 12.

Two slide rail members 20 are fastened with the two fastening supports.

A frame support 30 is fastened at one end thereof with the underside of the locating frame 10 for supporting the locating frame 10.

A first table top 40 is composed of two first leaves 40A and 40B and is mounted on the two slide rail members 20 such that the fastening supports 11 are completely concealed by the two first leaves 40A and 40B.

A second table top 50 is located between the fastening supports 11 and composed of two hinged second leaves 50A and 50B, which are smaller in size than the first leaves 40A and 40B and can be folded to superimpose each other. The second leaf 50B is provided with a guide rod 51 which is fastened therewith such that both ends of the guide rod 51 extend beyond the end sides of the second leaf 50B to be slidably retained in the guide slots 12 of the two fastening supports 11. When the two second leaves 50A and 50B of the second table top 50 are folded, the guide rod 51 slides to the lower initial point X2 of the guide slot 12. When the guide rod 51 slides to the upper initial point X1, the second leaves 50A and 50B are unfolded.

Figure 3:
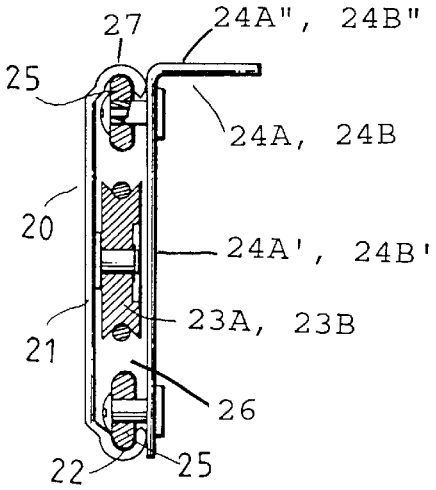
FIG. 3 shows an enlarged sectional view of the sliding mechanism of the preferred embodiment of the present invention.
Figure 4:
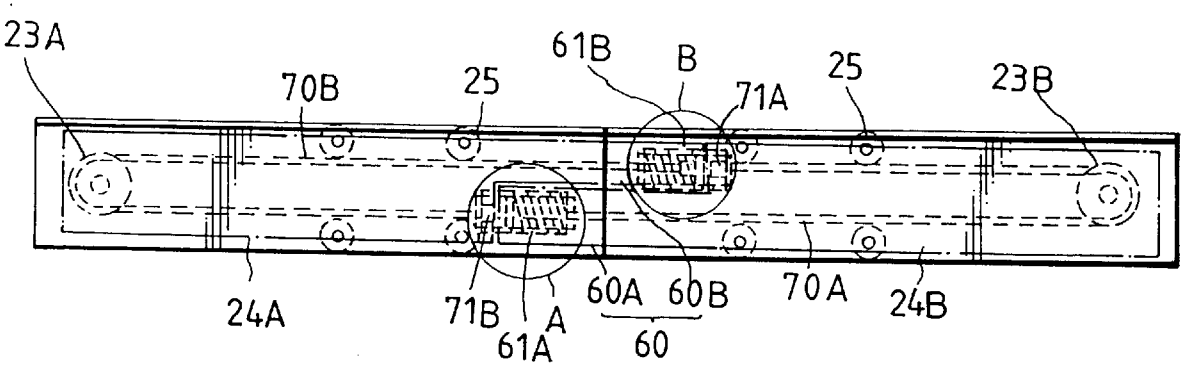
FIG. 4 shows a schematic view of the working relationship of the component parts of the sliding mechanism of the preferred embodiment of the present invention.
Figure 5:
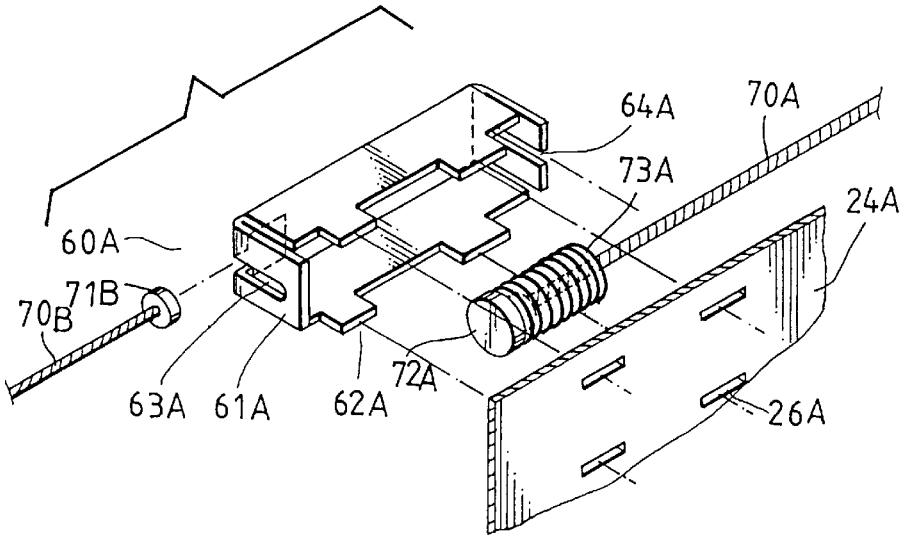
FIG. 5 shows an enlarged schematic view of the traction unit indicated by a circle "A" in FIG. 4.

Each of the slide rail members 20 is composed of a frame strip 21 which is provided with two recesses 22, two slide plates 24A and 24B fastened with the frame strip 21, eight guide wheels 25 fastened with the slide plates 24A and 24B such that the guide wheels 25 are received in the recesses 22 to enable the slide plates 24A and 24B to slide linearly. As shown in FIG. 3, this produces rail members 20 with a face 24A', 24B' of slide plates 24A, 24B another face 24A", 24B", and flush with the high point 27 of a top edge of frame strip 21. As shown in FIG. 5, the slide members 20 are further composed of the traction units 60A, 60B which are mounted respectively on the two slide plates 24A and 24B. The first traction unit 60A consists of a first containing case 61A having two parallel walls which are provided with a plurality of tenons 62A. The first containing case 61A is provided in one side thereof with a first slot 63A, and in another side thereof with a second slot 64A. The first slide plate 24A is provided with a plurality of through holes 26A for receiving therein the tenons 62A of the containing case 61A. A first cord 70A is fastened at one end thereof with a spring 73A and a stop block 72A which is put through the second slot 64A to rest against the inner side of the containing case 61A. The first cord 70A is fastened at another end thereof with a stop block 71A. The second traction unit 60B consists of a second containing case 61B corresponding to the first containing case 61A, and a second cord 70B. The second containing case 61B has two parallel walls which are provided with a plurality of tenons 62B, a first slot 63B, and a second slot 64B. The second cord 70B is provided at one end thereof with a spring 73B and a stop block 72B, and at another end thereof with a stop block 71B. These two traction units 60A and 60B are joined together such that the stop block 72A is received in the second slot 64A of the first containing case 61A. Similarly, the stop block 72B of the second cord 70B is received in the second slot 64B of the second containing case 61B. The first cord 70A is wound on the second slide wheel 23B such that the stop block 71A of the first cord 70A is retained in the first slot 63B of the second containing case 61B. In the meantime, the second cord 70B is wound on the first slide wheel 23A such that the stop block 71B is retained in the first slot 63A of the first containing case 61A. The first containing case 61A and the second containing case 61B are connected by the first cord 70A and the second cord 70B such that the two slide plates 24A and 24B can be moved away from each other and moved toward each other.

Figure 8:
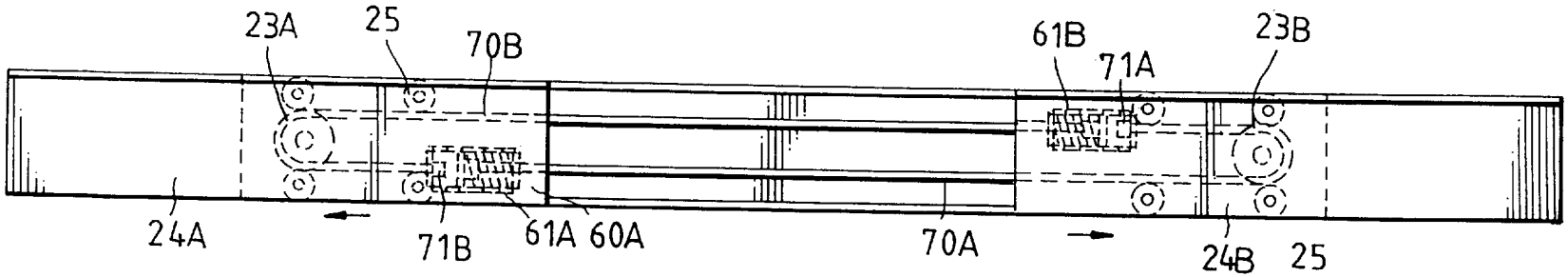
FIG. 8 shows a schematic view of the sliding mechanism of the present invention at work.
Figure 9:
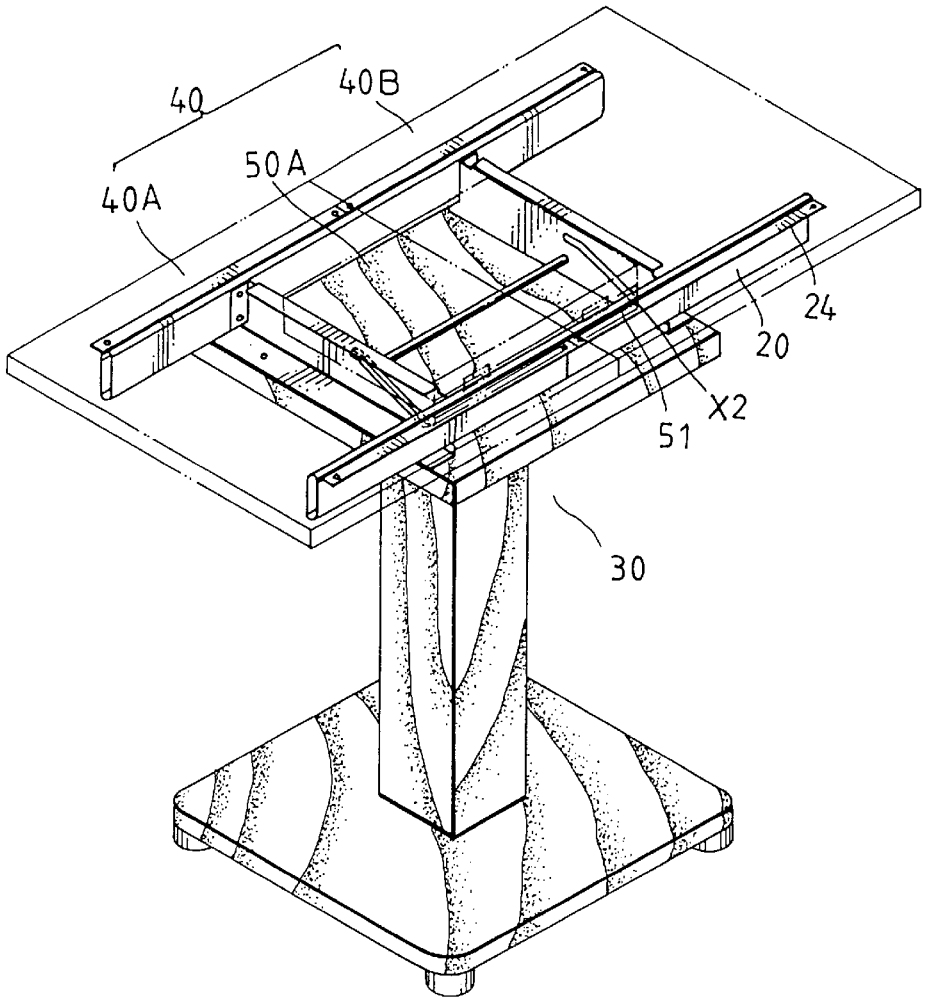
FIG. 9 shows a schematic view of a retracted table top of the preferred embodiment of the present invention.
Figure 7:
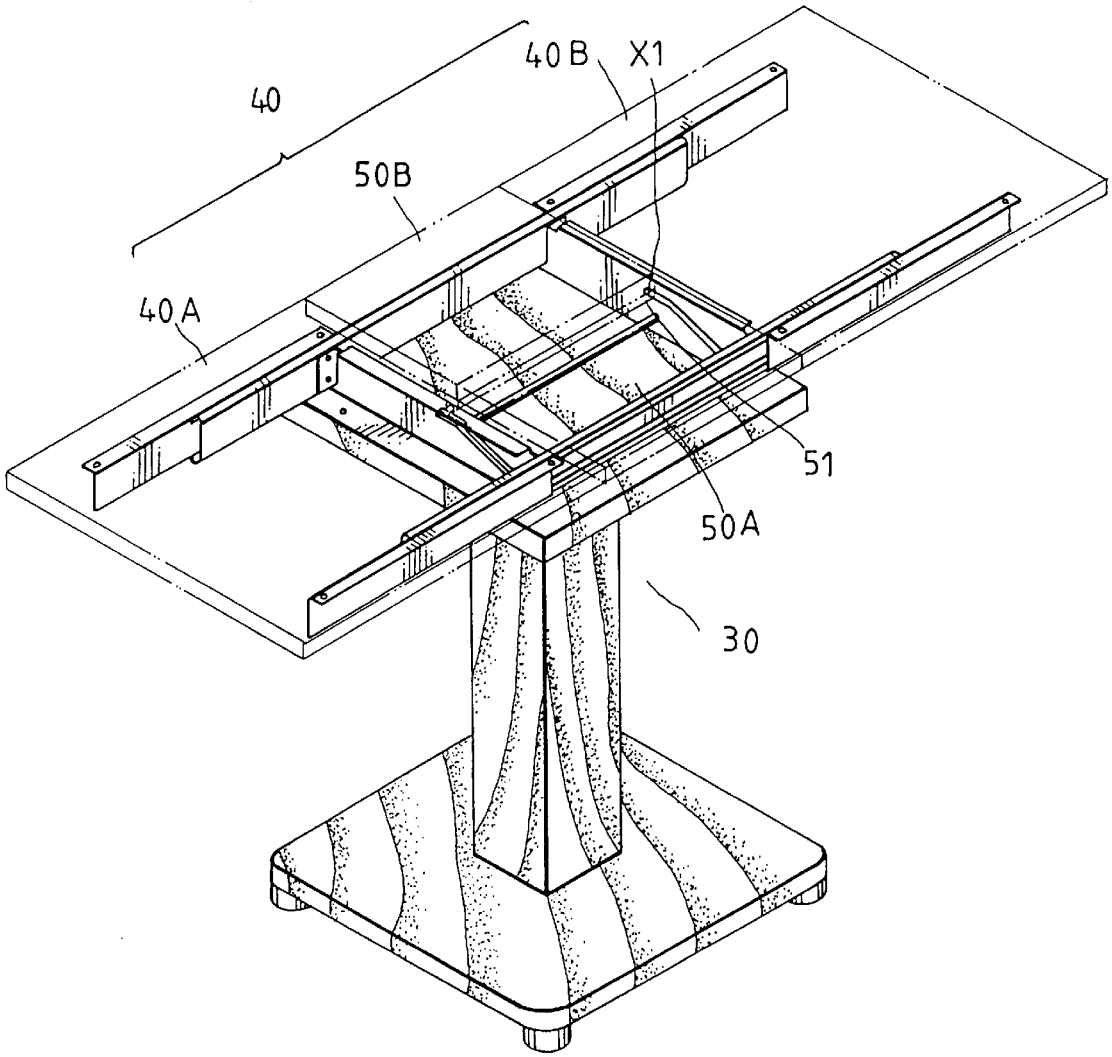
FIG. 7 shows a schematic view of an expanded table top of the preferred embodiment of the present invention.
Figure 6:
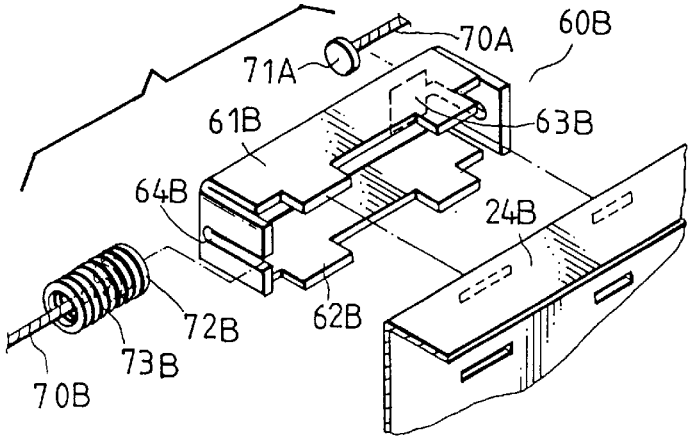
FIG. 6 shows an enlarged schematic view of the traction unit indicated by a circle "B" in FIG. 4.

As shown in FIGS. 7, 8, and 9, the two first leaves 40A and 40B of the first table top 40 are fastened with the short sides of the slide plates 24A and 24B of the two slide rail members 20. The area of the table top can be expanded by pulling the first leaf 40A or 40B to actuate the containing case 61A or 61B of the traction unit 60A or 60B to draw the first cord 70B to displace, thereby resulting in the slide plate 24B or 24A being actuated by the containing case 61B or 61A to displace in an opposite direction. As a result, the two slide plates 24A and 24B are caused to move away from the center line of the dining table, with the help of the guide wheels 25. Thereafter, the second table top 50 is raised such that the second table top 50 is moved by the guide rod 51 to the upper initial point X1 of the guide slot 12, and that the second table top 50 is then unfolded. Finally, the two first leaves 40A and 40B of the first table top 40 are pushed to join with the second leaves 50A and 50B of the second table top 50. The area of the table top may be reduced by folding the second leaf 50A in reverse to lay on the another second leaf 50B before being moved by the guide rod 51 to the lower initial point X2 of the guide slot 12. The first leaves 40A and 40B are then pushed toward each other to conceal the second table top 50.

The embodiment of the present invention described above is to be deemed in all respects as being illustrative and not restrictive. Accordingly, the present invention may be embodied in other specific forms without deviating from the spirit thereof. The present invention is therefore to be limited only by the scopes of the following appended claims.

What is claimed is:

1. A table comprising:

a locating frame having two fastening supports;

a sliding mechanism on said two fastening supports;

an underside of said locating frame fixed on a frame support;

a first table top having two leaves engaged on said sliding mechanism to permit said two leaves to be opened or closed together;

a second table top engaged between said two fastening supports such that said second table top can be raised or lowered in relation to said locating frame;

wherein said sliding mechanism comprises:

two slide rail members fixed to said two fastening supports;

each of said two slide rail members having a frame strip and two slide plates;

two slide wheels rotatably engaged at ends of each said frame strip;

a traction unit fixed to each of said two slide plates;

each traction unit consisting of a containing case fixed to one of said two side plates, a traction member fastened at a first end thereof with said containing case, said traction member being wound over one of said two slide wheels, and fastened at a second end thereof with another containing case fastened with another one of said two slide plates;

wherein said two slide plates are slidably engaged on each of said frame strips by a plurality of guide wheels rotatably engaged on each of said two slide plates to open or close said first table top.

2. The table as defined in claim 1, wherein each said containing case has a plurality of tenons and said slide plates have a plurality of through holes; wherein each said containing case is respectively fastened with each of said slide plates such that said tenons of said containing case are retained in said through holes of said slide plates.

3. The table as defined in claim 1, wherein each said frame strip is provided with two recesses.

4. The table as defined in claim 1 wherein each of said slide plates has a face respectively covering an opening of each said frame strip, and another face flush with a highest point of a top edge of each said frame strip.

5. The table as defined in claim 1, wherein each of said traction members is provided at one end thereof with an elastic member fitted thereover.

6. The table as defined in claim 5, wherein said elastic member is a spring.

7. The table as defined in claim 6, wherein each of said traction units is provided with a cord fastened with said elastic member and a stop block.

8. The table as defined in claim 1, wherein each of said two fastening supports is provided with a guide slot.

9. The table as defined in claim 8, wherein said second table top is composed of two hinged leaves, one of said two leaves being provided with a guide rod having two ends which are respectively retained in each said guide slot of said two fastening supports.

10. The table as defined in claim 8, wherein each said guide slot has an upper initial point, under which a locating rod is disposed.

* * * * *